United States Patent [19]

Shelton et al.

[11] Patent Number: 4,754,287

[45] Date of Patent: Jun. 28, 1988

[54] LOG PERIODIC ANTENNA WITH FORESHORTENED RADIATING ELEMENTS

[75] Inventors: Warren M. Shelton, Milpitas; Samuel C. Kuo, Saratoga, both of Calif.

[73] Assignee: GTE Government Systems Corporation, Stamford, Conn.

[21] Appl. No.: 118,378

[22] Filed: Nov. 9, 1987

[51] Int. Cl.[4] ..... H01Q 11/10

[52] U.S. Cl. ..... 343/792.5; 343/802; 343/803

[58] Field of Search ..... 343/792.5, 802, 803, 343/806, 807, 794, 795, 808, 908

[56] References Cited

U.S. PATENT DOCUMENTS

| | | | |
|---|---|---|---|
| 3,543,277 | 11/1970 | Pullara | 343/792.5 |
| 3,573,839 | 4/1971 | Parker | 343/792.5 |
| 3,732,572 | 5/1973 | Kuo | 343/792.5 |
| 4,673,948 | 6/1987 | Kuo | 343/792.5 |

OTHER PUBLICATIONS

Kuo; "Size Reduced Log Periodic Dipole Array"; 1970 G-AP International Symposium; pp. 151-158; 1970.

Kuo; "Size Reduced Log Periodic Dipole Array Antenna"; Microwave Journal (GB); vol. 15, No. 12; pp. 27-33, 1972.

*Primary Examiner*—William L. Sikes

*Assistant Examiner*—Hoanganh Le

*Attorney, Agent, or Firm*—Douglas M. Gilbert; John F. Lawler

[57] ABSTRACT

The foreshortened dipoles of the antenna described in U.S. Pat. No. 3,732,572 are further substantially shortened without performance impairment with a new construction in which each radiating element comprises a planar rectangular body electrically connected to the feed line by a stem attached to the body remotely from the feed line and spaced slightly from the plane of the body.

5 Claims, 4 Drawing Sheets

LOG PERIODIC ANTENNA WITH FORESHORTENED RADIATING ELEMENTS

BACKGROUND OF THE INVENTION

1. Field of the Invention

This invention relates to log periodic antennas and more particularly to log periodic dipole or monopole antennas with foreshortened radiating elements.

2. Description of the Prior Art

U.S. Pat. No. 3,732,572 describes a log periodic antenna in which radiating elements {dipoles} are foreshortened in order to conserve space without adversely affecting antenna performance. This is accomplished by configuring each size-reduced dipole with the interior profile of a double ridged waveguide. By use of this technique, a reduction of 45% in the length of the monopole or dipole antenna elements is achieved. However, when these foreshortened dipoles are used as radiation elements in a practical commonly used log periodic dipole antenna, the width of such antennas cannot be reduced as much. The reason for this is that these antennas have taper angles of approximately 25°. Therefore the available spacing between adjacent dipole elements is relatively small and this prevents the use of foreshortened dipole elements with large width-to-length (B/A) ratios when the planes of these elements are parallel to the antenna axis. For example, the width of a log periodic dipole antenna with a taper angle of 20° can be reduced up to 30%, and one with a 30° taper angle can only be reduced by approximately 25% Log periodic dipole antennas having a very small taper angle (less than 10°), and therefore characterized by long structures and large spacings between adjacent dipole elements, can be reduced up to 40% because foreshortened dipoles with large B/A ratios can be used. Nevertheless the 40% reduction in antenna width is still not sufficient to enable the antenna to fit into the space available in many applications. In addition, log periodic antenna structures with small taper angles may not fit into the space available in the orthogonal direction and a structure with a larger taper angle must be used.

This invention is directed to an improved antenna construction which overcomes these limitations.

OBJECTS AND SUMMARY OF THE INVENTION

A general object of the invention is the provision of a log periodic dipole or monopole antenna having radiating elements foreshortened by up to 70% and electrical performance (VSHR) equivalent to that of a corresponding conventional log periodic antenna.

Another object is the provision of a simple technique for designing a log periodic antenna with foreshortened radiators when available space is severely limited.

These and other objects are achieved with a radiating element (monopole or half a dipole) comprising a plane rectangular conductive body and a conductive stem connected at one end to one of the feed lines and at the opposite end to the edge of the body remote from the feed line, the stem being parallel to and closely spaced from the body.

DESCRIPTION OF PREFERRED EMBODIMENTS

Figure 1:
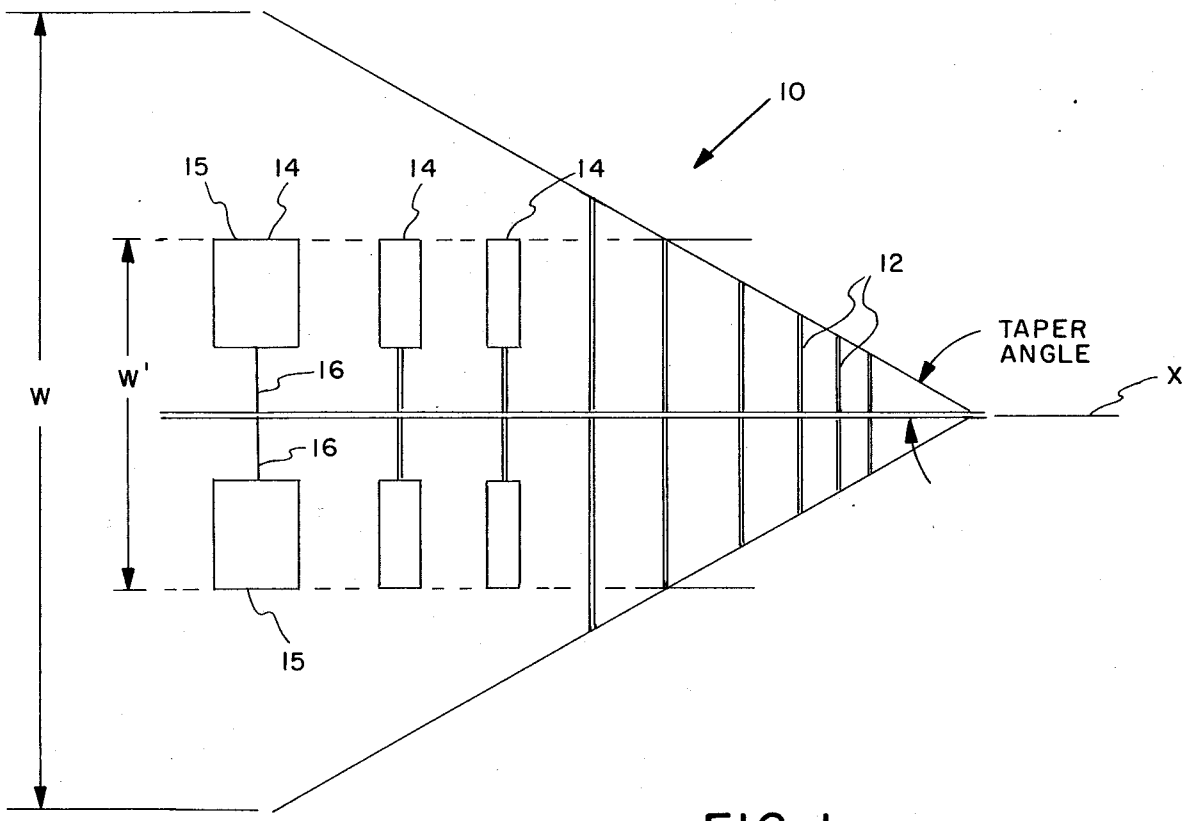
FIG. 1 PRIOR ART
FIG. 1 is a schematic plan view of a log periodic dipole antenna of the prior art.

Referring now to the drawings, FIG. 1 shows a the log periodic dipole antenna 10 described in U.S. Pat. No. 3,732,572 and having an axis X, an axially extending feedline 11, preferably a coaxial cable as shown, conventional rod-like dipoles 12 at the high frequency (right as viewed) end of the antenna, and foreshortened dipoles 14 at the lower frequency end. Each of conventional dipoles 12 has a length corresponding to $\lambda/2$ where $\lambda$ is the resonant frequency of the the particular dipole. Foreshortened dipoles 14 each comprise rectangular bodies 15 connected by wire-like stems 16 to feedline 11; each such foreshortened dipole has a length $<<\lambda/2$. The principle underlying the foreshortening of dipoles 14 of antenna 10 without significant change in operating characteristics is fully explained in U.S. Pat. No. 3,732,572. Through application of this principle to a conventional log periodic dipole antenna with a taper angle of 30°, the physical length of the conventional dipole has been reduced about 25%, i.e., the width W' of the low-frequency end of antenna 10 is about 25% of the width W of the conventional dipole antenna.

Figure 2:
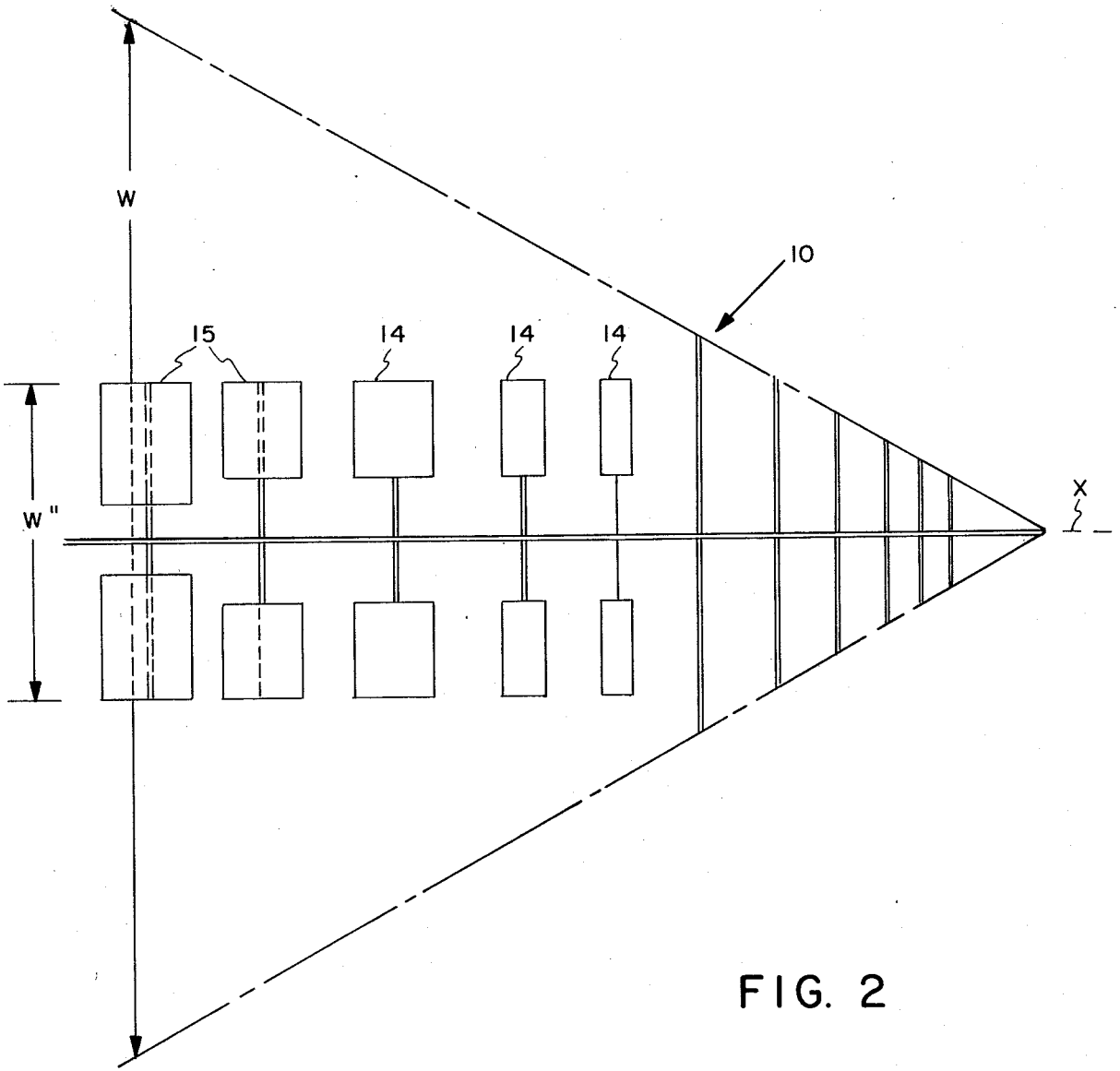
FIG. 2 is a view similar to FIG. 1 showing an embodiment of this invention.

The log periodic dipole antenna 10' shown in FIG. 2 is similar to antenna 10 of FIG. 1, like reference characters indicating like parts on the drawings, except that the two low-frequency dipoles 18 shown at the left in the drawing are constructed in accordance with this invention as described in detail below. The width W'' of antenna 10' is approximately 50% of the width W of the conventional dipole antenna, thus enabling its adaptation and use in space limited applications too stringent for antenna 10.

Figure 3:
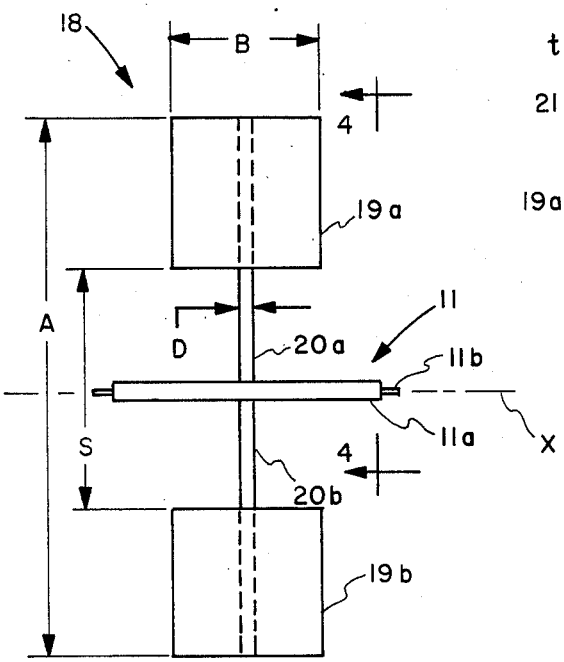
FIG. 3 is an enlarged view of one of the dipoles of the FIG. 2 antenna embodying the invention and showing details of construction.
Figure 4:
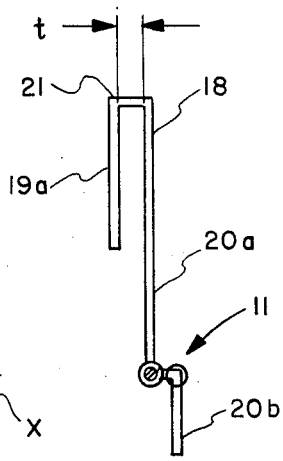
FIG. 4 is an edge view of part of the dipole taken on line 4—4 of FIG. 3.

Dipole 18 comprises identical rectangular bodies **19*a* and 19*b*, see FIGS. 3 and 4, connected by stems 20*a* and 20*b* to feed line 11 which extends along axis X of the antenna and is shown as a coaxial cable having an outer conductor 11*a* and an inner conductor 11*b*; stem 20*a* is connected to outer conductor 11*a* and stem 20*b* to inner conductor 11*b*. In this embodiment, each of bodies 19*a* and 19*b* is a plane electrically conductive sheet and each of stems 20*a* and 20*b* is an electrically conductive strip. The principal difference in the structure of dipole 18 compared to that of prior art dipole 14 shown in FIGS. 1 and 2 is that each of stem 20*a* and 20*b* extends parallel to, is slightly spaced by a distance t from the plane of the associated body 19, and is connected to the edge 21 of body 19** remote from axis X. The dimension t is relatively small, i.e. in the order of 1/10 to 1/20 of the dipole length, so that for operational purposes the antenna is essentially two-dimensional.

As explained in U.S. Pat. No. 3,732,572, the dipole length reduction factor is directly related to the ratios of parameters B/A and B/D, see FIG. 3. The larger the ratios, the larger the reduction factor obtainable. There is, however, a practical limit to the extent such ratios can be increased. Too large a ratio of B/D makes the antenna difficult or impossible to fabricate. Too large a ratio of B/A results in antenna support problems and incompatibility with log periodic dipole antenna design. For these reasons, ratios B/A and B/D in the antenna described in the above patent are limited to 0.3 and 20, respectively. Furthermore this prior art antenna has a near optimum ratio of S/A of 0.55. In comparison, a dipole foreshortened in accordance with this invention had the following dimensional ratios:

B/A—0.3
B/D—10
S/A—0.05

The latter dipole had the same resonant frequency as that of a conventional linear dipole having a length 2.5 times the dimension A in FIG. 3. This corresponds to a reduction factor of 60% as compared to the dipole described in the above patent where the maximum obtainable reduction factor is approximately 38% with the same B/A and B/D ratios. However, when these dipoles or monopoles are used as stand alone antennas, B/A ratios $>0.3$ can be used. In which case, a reduction factor of 70% is obtainable.

Figure 5:
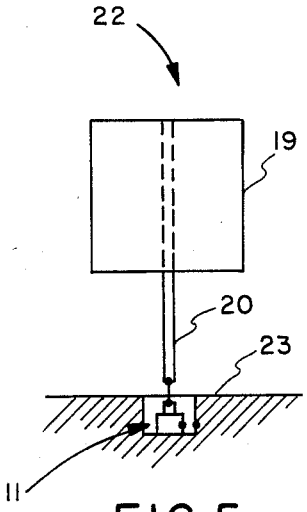
FIG. 5 is a view similar to FIG. 3 showing a monopole embodying the invention.
Figure 6:
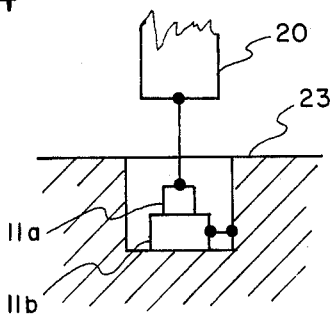
FIG. 6 is an enlarged view of part of FIG. 5 showing details of the monopole feed.

The invention may also be practiced with a monopole antenna 22, see FIGS. 5 and 6, having the same structure as one-half of dipole 18 and mounted over a planar conductor 23 such as a metal sheet or ground, like reference characters indicating like parts on the drawings. Antenna 22 is fed by coaxial cable 11 with inner conductor 11*a* connected to stem 20 and outer conductor 11*b* connected to planar conductor 23.

Figure 7:
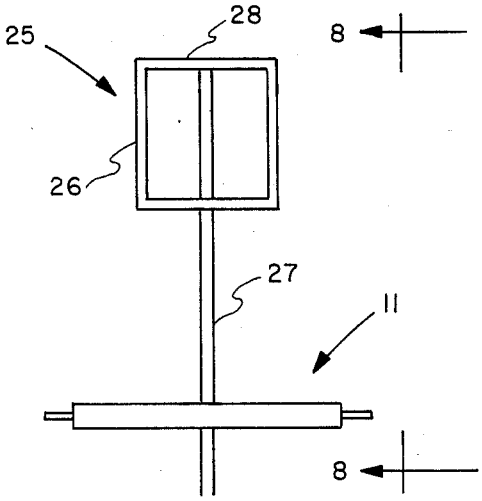
FIG. 7 is a schematic plan view of half a dipole embodying a modified form of the invention.
Figure 8:
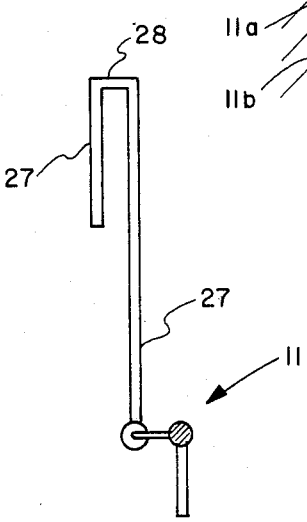
FIG. 8 is an edge view taken on line 8—8 of FIG. 7.

Another embodiment of the invention is shown in FIGS. 7 and 8 in which dipole 25, one-half of which is illustrated, has an open-faced rectangular body 26 connected by stem 27 to feedline 11. Body 26 may be formed by wire or the like as described in the above patent, stem 27 being slightly laterally spaced from body 26 and connected to the central part of the edge 28 thereof remote from feed line 11. This form of the invention is useful in outdoor applications where wind is a factor.

Figure 9:
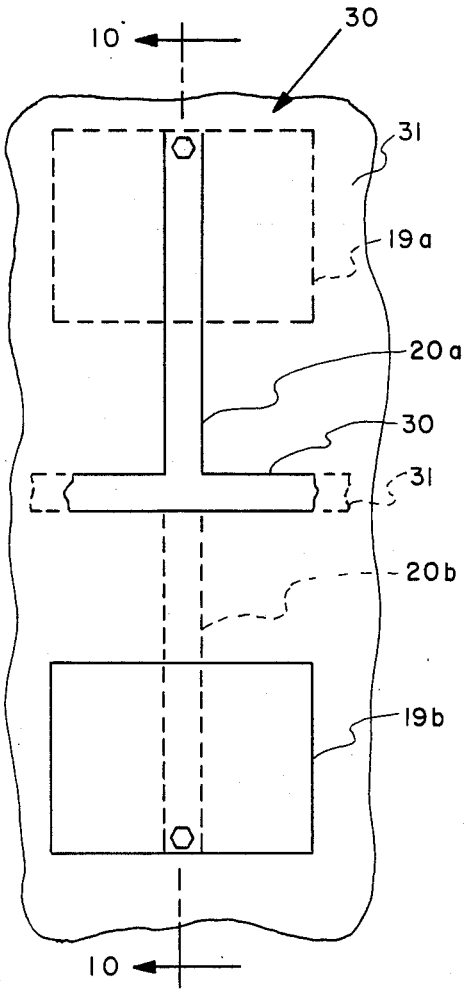
FIG. 9 is a schematic plan view of a dipole embodying the invention and fabricated using the printed circuit board technique.
Figure 10:
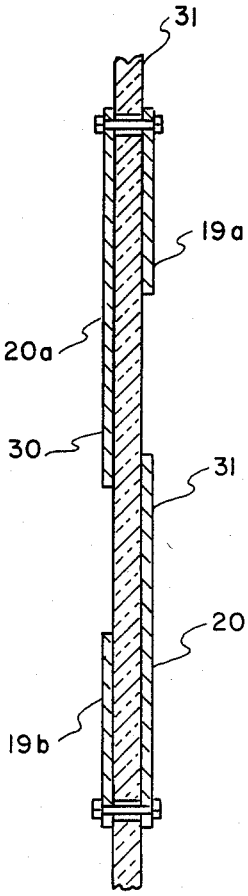
FIG. 10 is a section taken on line 10—10 of FIG. 9.
Figure 11:
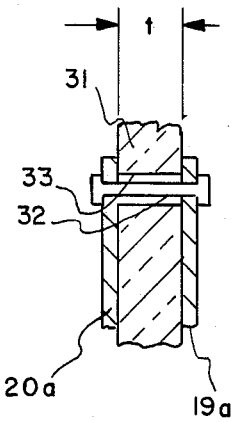
FIG. 11 is an enlarged view of part of FIG. 10.

FIGS. 9, 10 and 11 illustrate another embodiment of the invention in which the dipole 30 is formed by the printed circuit (PC) technique, like reference characters indicating like parts on the drawings. One-half of dipole 30 is formed on one side of PC board 31, the other half on the opposite side. Each of bodies 19*a* and 19*b* of the dipoles preferably is in sheet form as shown but may also have an open configuration as in dipole 25 (FIGS. 7 and 8). Stems 20*a* and 20*b* connect to and are integral with strip feed lines 30 and 31 on opposite sides of board 31 and are connected at the outer edges, respectively, of bodies 19*a* and 19*b* by pins 32 extending through holes 33 in board 31. The thickness t′ of board 31 corresponds to the lateral offset t of stems 20 from the planes of rectangular bodies 19 in the embodiments described above. The high production and precision capabilities inherent in forming such antennas by printed circuit technology make this embodiment of the invention highly cost effective. The formation this antenna by printed circuit technology enables high volume production with corresponding high quality.

What is claimed is:

1. A log periodic antenna having an axis and comprising:

a pair of axially extending feed lines;

a plurality of axially spaced dipoles connected to said feed lines and extending in directions transversely of said axis;

certain of said dipoles having lengths $<<\lambda/2$ where $\lambda$ is the wavelength at the resonant frequency of the respective dipole;

each of said certain dipoles having two identical elements on opposite sides of said axis, each of said elements having a stem connected at one end to one of said feed lines and a rectangular body spaced in a first direction from said one of said feed lines and spaced in a second direction transversely of said first direction from said stem, the other end of said stem opposite said one end thereof being connected to said body along the edge thereof remote from said axis.

2. The antenna according to claim 1 in which said body is an electrically conductive continuous sheet.

3. The antenna according to claim 1 in which said body is an electrically conductive wire.

4. A log periodic antenna having an axis and comprising:

a pair of axially extending feed lines;

a plurality of axially spaced dipoles connected to said feed lines and extending in directions transversely of said axis;

certain of said dipoles having lengths $<<\lambda/2$ where $\lambda$ is the wavelength at the resonant frequency of the respective dipole;

each of said certain dipoles having identical parts on opposite sides of said axis, each of said parts having a stem and a radiating body, said stem being connected to one of said feed lines and extending therefrom transversely of said axis, said body being spaced from said axis and having a generally rectangular outline and lying in a plane extending parallel to and laterally spaced from said stem, said stem being connected to said body along the edge of the latter remote from said axis.

5. A log periodic monopole antenna having an axis and comprising:

a planar conductor;

an pair of axially extending feedlines;

a plurality of axially spaced monopoles electrically connected to one of said feed lines and extending in a direction transversely of said conductor, said conductor being connected to the other of said feed lines;

certain of said monopoles having lengths $<<\lambda/4$ where $\lambda$ is the wavelength at the resonant frequency of the respective monopole;

each of said certain monopoles having a stem and a radiating body, said stem being connected to said one of said feed lines and extending therefrom transversely of said axis, said body being spaced from said conductor and having a generally rectangular outline and lying in a plane extending parallel to and laterally spaced from said stem, said stem being connected to said body on the part of the latter remote from said axis.

* * * * *